US005221089A

United States Patent [19]

Barrett

[11] Patent Number: 5,221,089

[45] Date of Patent: Jun. 22, 1993

[54] GOLF SWING TRAINING AID KIT AND METHOD

[75] Inventor: George Barrett, Mobile, Ala.

[73] Assignee: Gobar Enterprises, Inc., Mobile, Ala.

[21] Appl. No.: 911,946

[22] Filed: Jul. 10, 1992

[51] Int. Cl.[5] ..... A63B 69/36

[52] U.S. Cl. ..... 273/187.2; 273/188 R; 273/191 B; 434/252; 206/315.1

[58] Field of Search ..... 273/187.2, 188 R, 191 B, 273/187 R, 195 A, 189 R, 187.1; 434/252; 206/315.1

[56] References Cited

U.S. PATENT DOCUMENTS

| | | | |
|---|---|---|---|
| 2,893,736 | 11/1957 | Tesi | 273/188 |
| 3,698,721 | 10/1972 | Stewart | 273/188 R X |
| 4,346,896 | 8/1982 | Russell et al. | 273/195 A |
| 4,422,643 | 12/1983 | Cushing | 273/183 B |
| 4,479,653 | 10/1984 | Woodson | 273/183 B |
| 4,522,406 | 6/1985 | Targuinio | 273/195 A |
| 4,593,909 | 6/1986 | Anselmo | 273/188 R |
| 4,662,640 | 5/1987 | Grander | 273/183 B |
| 4,758,001 | 7/1988 | Otting | 273/188 R |
| 4,883,276 | 11/1989 | Brown | 273/183 B |
| 4,892,317 | 1/1990 | Corder | 273/183 B |
| 4,895,373 | 1/1990 | Richmon | 273/183 B |

OTHER PUBLICATIONS

Golf Digest, May 1992, Advertisement, p. 94 "The Perfect Swing Trainer".

*Primary Examiner*—George J. Marlo
*Attorney, Agent, or Firm*—Robert Montgomery

[57] ABSTRACT

A golf swing training aid kit comprising three golf practice aids, each of which can be used independently or all three may be used together. The kit, a brief-case sized box opens to form a platform. A self-contained collapsible pole is affixed therein and is adjusted for user height. The pole, held rigidly upright by means of struts and the golfer's weight while standing on a portion of said box, further comprising horizontal bars which provides passive limits to the motion of the golfer's hips.

A second aid comprises a chest harness to which a lanyard is attached and whereby said lanyard's free end is looped around the center most part of a golf club's hand grip. Thereby, training the golfer in correct arm and wrist movement.

The third related aid, a brightly colored ribbon having eyelets, for attaching ground anchors, for marking out the correct path to be followed by the club head during the golfer's swing. Each of the three aids independently address different aspects of a golfer's swing whereas all three address most of the golfer's swing problems.

19 Claims, 14 Drawing Sheets

GOLF SWING TRAINING AID KIT AND METHOD

BACKGROUND OF THE INVENTION

The present invention relates specifically to the sport of golf and more particularly to golf training aids that provide guidance during practice in a manner that fulfills the purpose for which it is intended. The purpose being the improvement of the golfer's ability to strike a golf ball effectively. The need for such guidance has been recognized almost since the game of golf was invented. Over the generations many instructional devices have been offered to the learning golfer. Such devices include oral or written information, tips, demonstrations and general advice. Elaborate devices have been constructed which were intended to restrict the golfer's movement of his limbs or torso or both together in a predetermined and supposedly effective manner or, alternatively, to prevent his moving where movement was seen to be detrimental. Such devices are intended to demonstrate the correct mechanics of a swing and the golfer is expected to become acclimated to the new habits for use on the course. However, since the golfer cannot play encumbered by a training device, it is therefore obvious that any training method must train the golfer in a manner that does not make him actually reliant on the device. The device must demonstrate proper procedure without constraints.

Otting and Williams, U.S. Pat. No. 4,758,001, teaches an invention having two separate aids consisting of a frame work for passively limiting the rightward movement of the golfers right leg during the swing. This device comes closest to the present invention in that it provides passive limits, however the device fails to provide the same passive limitation to the hip where it is really needed. The second aid comprises a tether fastened to the golfer's waist and thigh and anchored to the ground a few feet away from the golfer and immediately to his left when addressing the ball. While the intention of the device, to prevent lateral movement of the hips, is commendable, the device is substantially ineffective as a training aid in that it only restricts hip sway, and then, in only one direction. Removal of the restraints leaves the golfer with a sense of loss and poor balance.

Tesi U.S. Pat. No. 2,893,736 teaches the use of a bridle attached to the golfers waist and subsequently attached to a platform upon which he stands when addressing the ball. The object being to perfect the golfers stance when addressing the ball through repeatedly utilizing the bridle adjusted to the proper length for the correct posture when addressing the ball. However, without knowing what the proper stance and posture should be, they would be impossible to ascertain with this device. Utilizing the golfers belt loops, to secure the bridle, would simply serve to tug the golfer pants down to a lower level when an error is made. Thereby, serving no restrictive purpose. This device does utilize a platform and the golfers own weight for stabilization while in use.

Anselmo, U.S. Pat. No. 4,593,909, teaches the use of a framework structure attached to the golfer with belts. The overall intention being to restrict erroneous movement of the golfer's torso while still allowing him to pivot. Although the apparatus claims to be dismantleable and easily transported, if such an apparatus is designed substantial enough to insure that even the most truculent and vigorous golfer would be forced to comply, the apparatus would necessarily be extremely heavy. The apparatus of Anselmo provides no passive limits and makes no attempt to guide the golfer in terms of weight distribution, which is considered an important aspect of the golfer's swing.

The aforementioned patents cannot be considered to be compact, easily transported, considered unrestrictive in use or provide positive passive instruction. In most cases the golfer relies heavily on the apparatus and is hard pressed to repeat the movement when it is removed.

Richmond, U.S. Pat. No. 4,895,373, teaches the use of a belting which encircles the left shoulder and attaches to the waist. The idea being, to co-ordinate the movements of shoulder and hips during the golf swing. The shoulder sling fails to address the golfers problems involving grip and wrist cock or proper rotation of the hip with respect to center of gravity.

Corder, U.S. Pat. No. 4,892,317, utilizes a chest and shoulder strap arrangement which restricts the erroneous movements of the upper arm relative to the chest. Corder, further utilizes hook and latch material on the straps to prevent muscle injury and provide feel and sound effects when an error is made.

Brown, U.S. Pat. No. 4,883,276 teaches the use of a chest panel the purpose being to serve as an inclinometer for the body by attempting to train the golfer to keep the mid-section of the body as near vertical as possible during the swing. Therefore, the golfer becomes acutely aware of one aspect of the center of gravity problem. Although passive in nature, this device fails to set any limits within which the golfer should reside, nor does it teach the golfer what should be done to correct the problem.

Grander, U.S. Pat. No. No. 4,662,640, utilizes a harness fitted around the golfers chest and shoulders, elastic cords attached thereto, are then connected to a special golf club consisting of a weighted shortened shaft having a special grip shaped to fit the hands. This apparatus addresses the need to allow the golfer, freedom of movement, while attempting to provide certain restraints. However, the apparatus, due to its elastic cords, exert unnatural stress on the artificial club during the swing. The apparatus fails to provide the golfer with a means of achieving a true radii, due to the duel cords connected to the clubs handle having two radius points. The elastic cords allow the golfer to bend his elbow and to change the radii of the arc during the swing. The apparatus further fails to address any aspects of wrist-cock.

Woodson, U.S. Pat. No. No. 4,479,653, presents another special designed shortened club attached at its upper end via a universal ball joint to a belt extension lying against the golfer's left thigh which in turn is secured to a waist belt. The device is intended to control the pronation of the hands by locating the upper end of the club. This apparatus places unnatural restrains on the golfer by not allowing the golfer to produce a full swing. The use of different clubs is prohibited and the weight of the special grip and shaft is also unnatural.

Cushing, U.S. Pat. No. 4,422,643, utilizes a chest harness to which is secured a solid bar positioned diagonally across the golfer's chest from the region of the left hip to the region of the right shoulder. The device is intended to control the vertical motion of the arms by serving as a guide for them to slide along the bar during the swing. This apparatus although passive in nature fails to produce the desired result by allowing the golfer to bend his elbows and still remain in contact with the bar. The bar is also only useful, if at all, in the back swing. The inventor also alludes to the need for additional training requirements to complete the stroke.

Again none of the aforementioned devices provide the golfer with any positive information. Each, discloses a restrictive device primarily intended to prevent a specific action or behavior. The prevention of an action cannot be expected to teach or encourage an alternative action. Most of the reported devices are apparently based on erroneous beliefs and faulty analysis of the swing. Learning golfers who use such devices to improve their golf swing, seldom have knowledge of physics or engineering, and as a consequence, are not comfortably in situations which try to impose the knowledge of the true mechanics of the swing upon them. Devices conceived by those having the required knowledge are more often successful. One such device is "The Perfect Swing Trainer". An apparatus consisting of a framework supporting a large circle comprised of PVC tubing formed in the arc plane of a perfect swing. The practicing golfer stands within the circle and follows the circle with the shaft of his club. The apparatus not only prevents erroneous movement of the club but it also teaches the learning golfer the correct motion, without restrictions of the golfer's limbs or torso.

SUMMARY OF THE INVENTION

The present invention although unlike "The Perfect Swing Trainer" shares similar characteristics. As with most golf training aids the basic objective of the present invention is to improve the learning golfers ability to strike a golf ball effectively. To obtain this objective the golfer must eliminate errors and develop consistency. The average golfer has many faults, some of which, for one reason or another, might never be eradicated. However, research and study have isolated some basic errors which are so common as to be almost normal behavior and yet may be eliminated fairly easily. They are so basic as to be identifiable with many dependent errors, which have come to be seen as faults, when in fact they are merely manifestations of a deeper problem.

A well-known "error" such as moving the head prior to striking the ball is often characterized as one of the prevailing faults. This simple error is simply a manifestation of a more fundamental problem. The actual fault stems from the shifting of the golfer's center of gravity, which may also be expressed as a change in the weight distribution. A little thought will demonstrate that the head is not located at the center of gravity but the hips are. If the hips are allowed to move about, the center of gravity will move about concomitantly. Subconscious attempts to maintain an even balance cause the upper body to reposition and, consequently, the head moves.

When the center of gravity shifts, the center of the golfers swing arc also moves. When the swing arc moves, the arc itself must follow a new path. Therefore, change in center of gravity is the basic cause of, poor timing, incorrect club head direction through the ball, incorrect club head action and virtually every other problem experienced by the learning golfer. If the golf ball is to be struck consistently and effectively, the center of the swing arc must be under control; Therefore, the center of gravity must be under control; for the center of gravity to be under control, the hips must be under control. For the learning golfer to learn control he must not be constrained by artificially imposed limits against which he strives. The removal of the constraints will only compel him to reach beyond the previously imposed limits. He must impose the limits from within himself and the training devices must simply guide him as to where he should impose such limits.

A single devise or training aid can not correct all the learning golfer's faults. Therefore, the present invention provides the golfer with a kit comprising three aid devices that address all the problems of the learning golfer. The first part of the present invention utilizes the carrying case itself as a platform, upon which the golfer stands when addressing the ball in order to teach the placement of the golfers feet in relation to the ball, and the placement of the hips in relation to the feet. Thus, correct body weight distribution is established. The amount of bending to address the ball, the location and controlled movement of the hips on the back-swing, the alignment of the feet, hips and shoulders relative to the target, and the timing of the downswing, can all be accomplished without more than the first of the three guides provided.

The second golfing aid furnished with the training kit is a chest harness to be worn by the learning golfer. The harness comprising a swing harness which attaches around the golfer's chest immediately below the armpits. The harness serving as an anchor point for a steel ring attached thereto, located just below one armpit, to which is attached a cord or lanyard. The cord or lanyard, in turn, is adjustable and attaches by a looped end around the approximate center of the grip on any golf club. The hands when in the normal golfing grip are then located on either side of the cord or lanyard. Provided that the cord is kept extended, the leading arm will remain straight, the feel of the pronation of the hands will come naturally and the cocking of the wrists will follow smoothly. The harness is designed to assist the golfer improve his swing by encouraging the golfer to keep his leading arm straight and extended for as long as possible. It does not however, attempt to prevent the arms from bending. He may bend his arms as much as he likes with no hint of discomfort. The chest harness and its attached cord or lanyard when attached to the club does not enforce a limit, beyond which the golfer may not go; it only provides him with a target behavior. Thus, the golfer is simply given the opportunity to learn the proper technique while given the opportunity to experiment and develop his own particular nuances of motion and style. He can then repeat the specific action as many times as he wishes and each repetition will be the same as the one before. This is especially true in terms of the cocking of the wrists, the position of the hands on the club can affect the style, rhythm and timing of the entire swing.

A third part of the learning golfers training kit is a means for providing a sight guide line for the club head during the back swing and follow-through after the ball has been struck. The sight line of the club head is the path the club head appears to follow during the stroke from the golfers point of view. From the golfers point of view this sight line appears to be straight, while appearing to be distinctly curved when viewed by an observer. The present invention provides a means of marking the sight guide line which is simple and easy to use and is distinguishable by peripheral vision while the golfer's eyes remain focussed on the ball during his stroke. This aid comprises a length of bright yellow ribbon having eyelets for securing to the earth in a manner so as not to allow movement during use. It width should always be a minimum of one inch and preferably two inches. The length must be sufficient to provide a sight line equal to that of the golfers swing. The aid of the present invention is provided with sufficient length to accommodate most golfers. As a rule the ribbon is positioned approximately three feet ahead of the ball in line with the target and three feet behind the ball away from the target. The ribbon is provided with metal eyelets at each end to enable it to be secured by earth anchors or the like. The ribbon should be placed in a manner so as it will not be struck by the club head. It is recommended that it be placed parallel to the club's swing path but slightly away from the club head's reach.

Each of the training aids supplied in the kit of the present invention addresses specific swing problems encountered by most learning golfer or anyone who would like to improve their golf game. Even though, the aids can be used individually, it is recommended that they be used in combination to perfect the golfers full form.

Therefore, the primary objects of the invention are as follows: It is the primary object of the present invention to provide the learning golfer with a training aid kit by which he can perfect the swing techniques without he use of physical restraints.

It is a further object of the present invention to provide a means of instructing the golfer in the proper movement of the hips by providing limits rather than restraints or restrictions to movement.

It is a further object of the present invention to provide a means for instructing the golfer in the specific locations for his feet relative to the position taken up by a golfer in preparation for striking the golf ball.

A further object of the present invention is to provide the training golfer with a physical barrier located substantially perpendicular to an imaginary line drawn through the golfers two hips, fixed in location relative to the golfer's feet at set-up during practice.

It is a further object of the present invention to provide a means of communicating to the practicing golfer the relative position and or motion of his buttocks. Thereby, allowing the golfer to maintain the proper center of gravity, the amount of bending, and the rotational or linear motions of his hips during practice.

It is still a further object of the present invention to provide a means by which a spatial relationship exist between the location of the golfer's feet and the aforementioned limiting barriers which causes the golfer to take up a specific set-up position. Whereby, the golfer's center of gravity will be shifted from one foot to the other during the swing.

It is still another object of the present invention to utilize the weight of the golfer as he stands with his feet on a portion of the invention to provide considerable stability to the apparatus. In particular, any force imparted by the golfer against the aforementioned barriers shall tend to work against the golfer's own weight.

A further object of the present invention is to provide an apparatus which is easily erectable and dismantleable in a manner so it may be packed for ease of transport and carried with one hand by an average adult female.

It is yet another object of the present invention that the base board or platform on which the golfer stands forms the components of a box. Whereby, with suitable folding or hinging, the apparatus mounted therein and the other aids comprising the kit may be packed.

A further object of the present invention is that a means shall be supplied which encourages the maintenance of a straight arm during the swinging of a golf club through an established radii, which also allows the perfection of the pronation of the hands in relation to the cocking of the golfer's wrists during the backswing.

Still another object of the present invention is to provide a means to simplify the observation of the club head action during practice swings by providing a reference means by which the golfer can see the direction of the club head in reference to a line without taking his eyes off the ball

A BRIEF DESCRIPTION OF THE DRAWINGS

FIG. 1*a* is an isometric view of the present invention in a folded and packed for transport condition.

FIG. 1*b* is an isometric view of the present invention in a partially open condition.

Figure 4A:
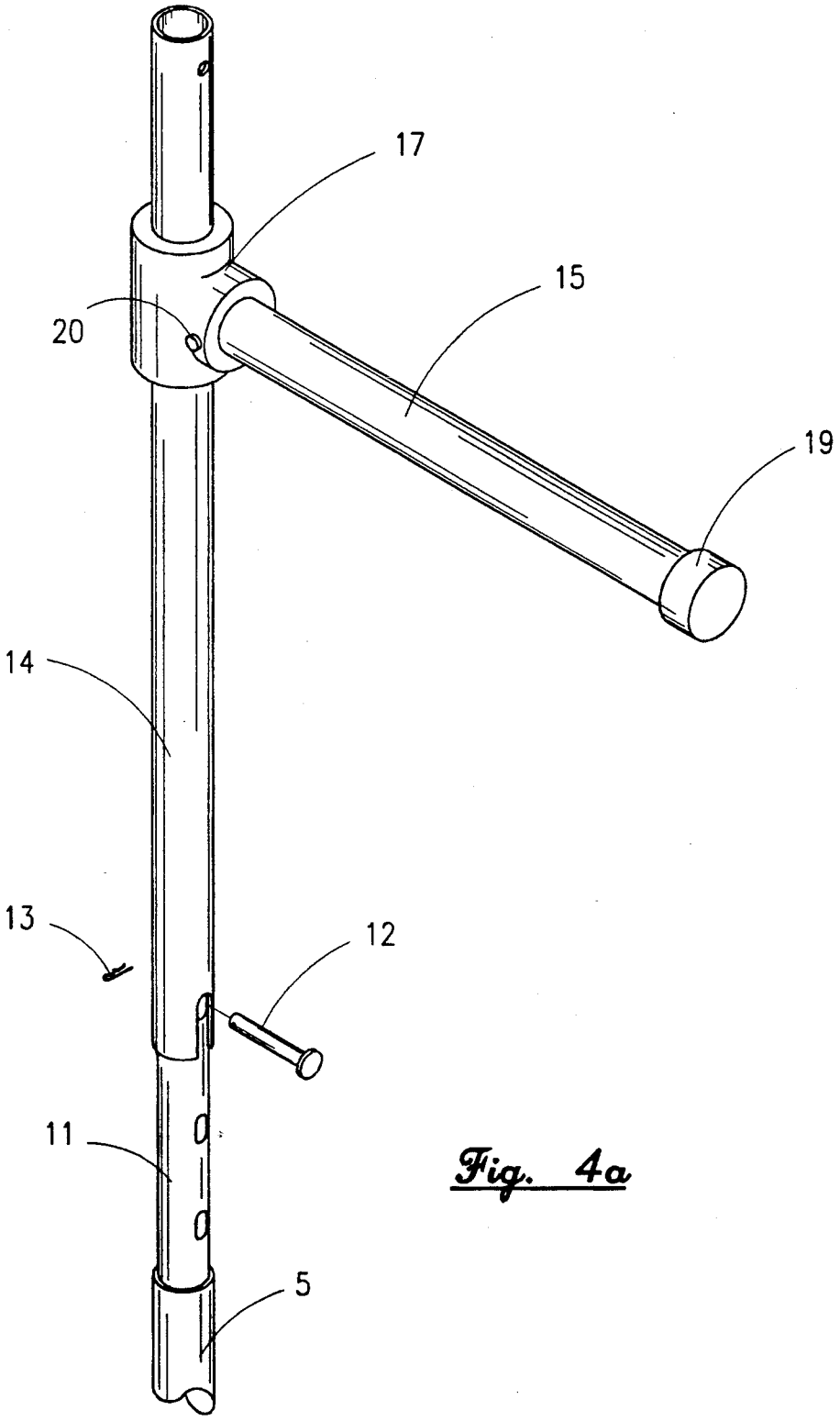

FIG. 4*a* is an elevation view of the height adjustment mechanism.

Figure 4B:
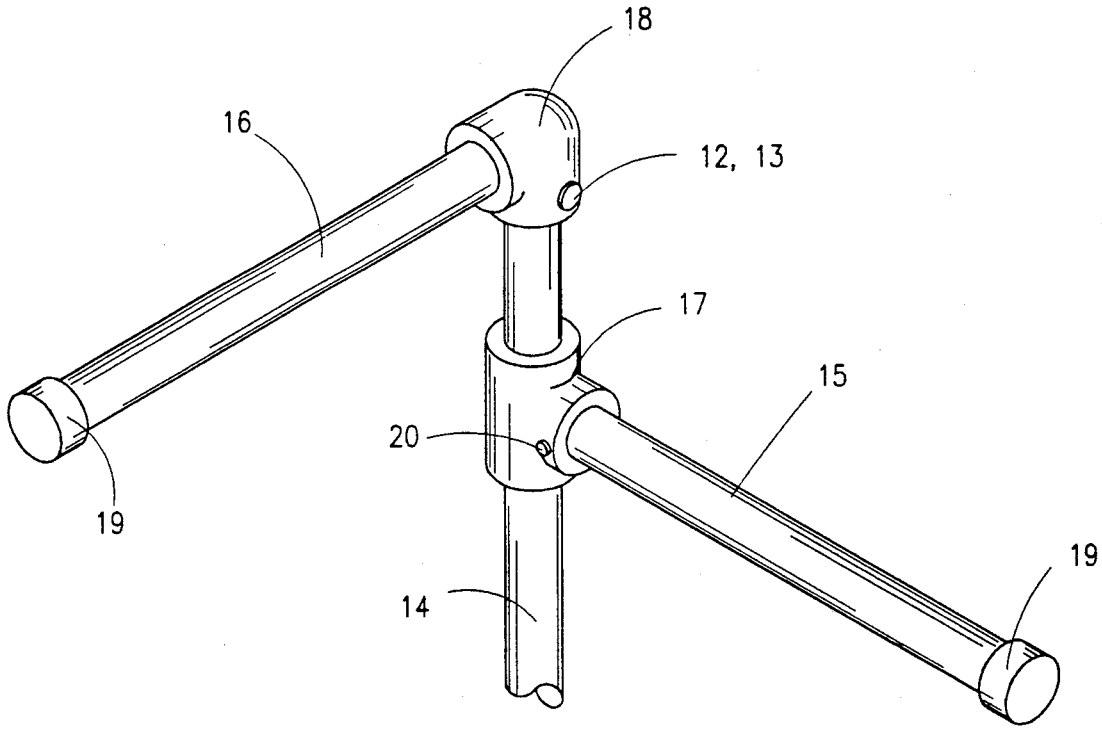

FIG. 4*b* is an elevation view of the hip bar assembly.

Figure 5:
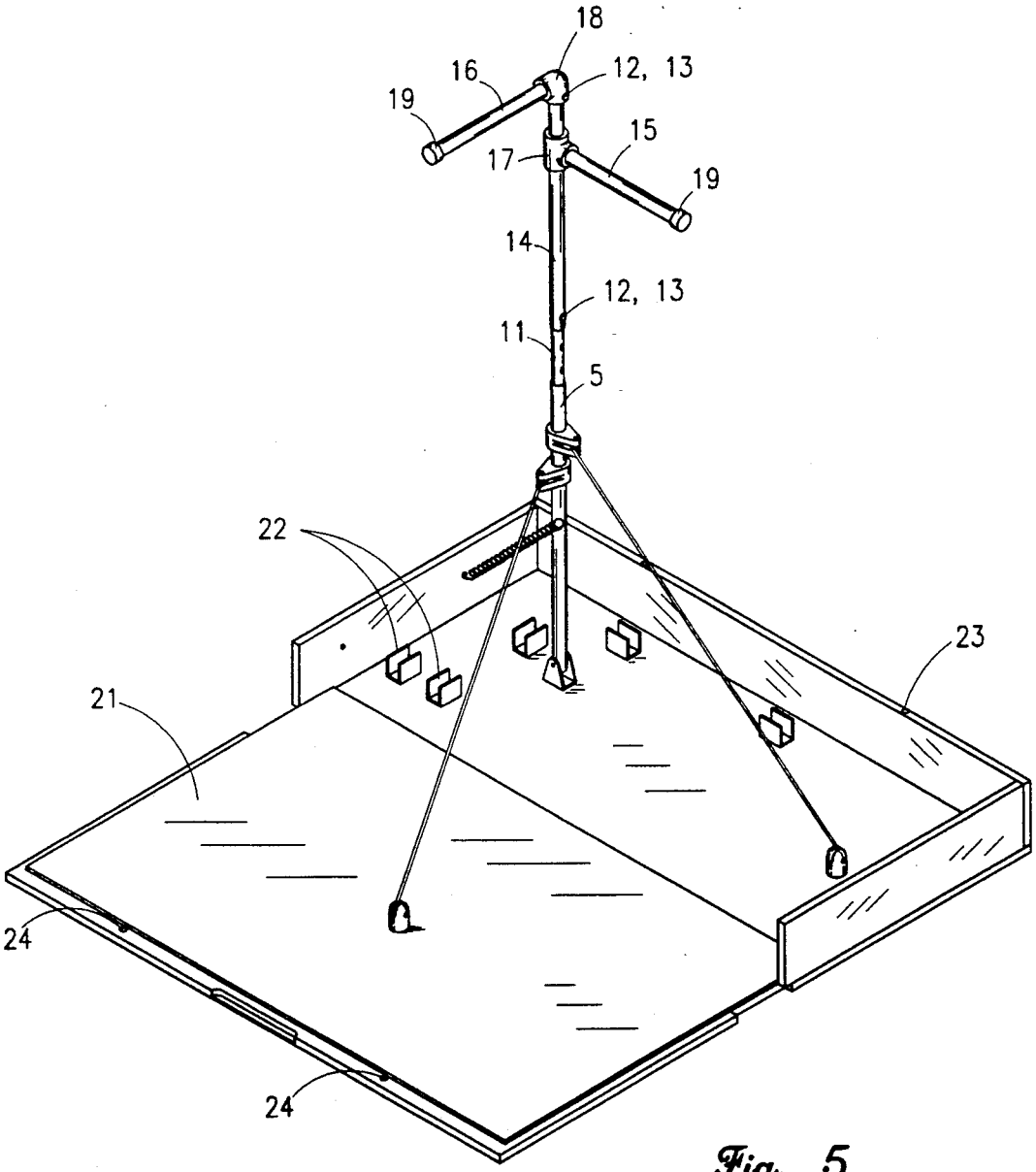

FIG. 5 is an isometric view of the fully erected guyed pole and hip bar assembly.

Figure 6A:
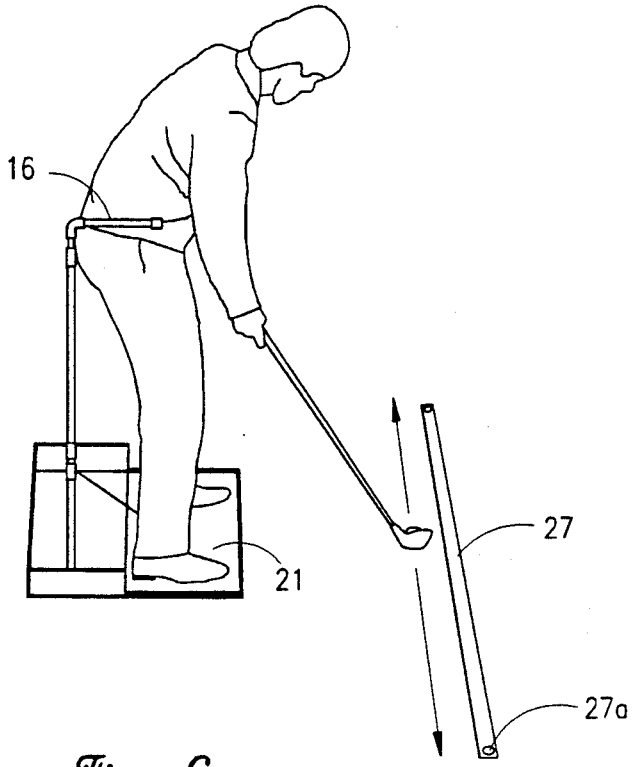

FIG. 6*a* is a vertical side isometric view of a golfer utilizing the apparatus of the present invention and the golfer's relationship to the various parts thereof. The golfer shown in the set-up position.

Figure 6B:
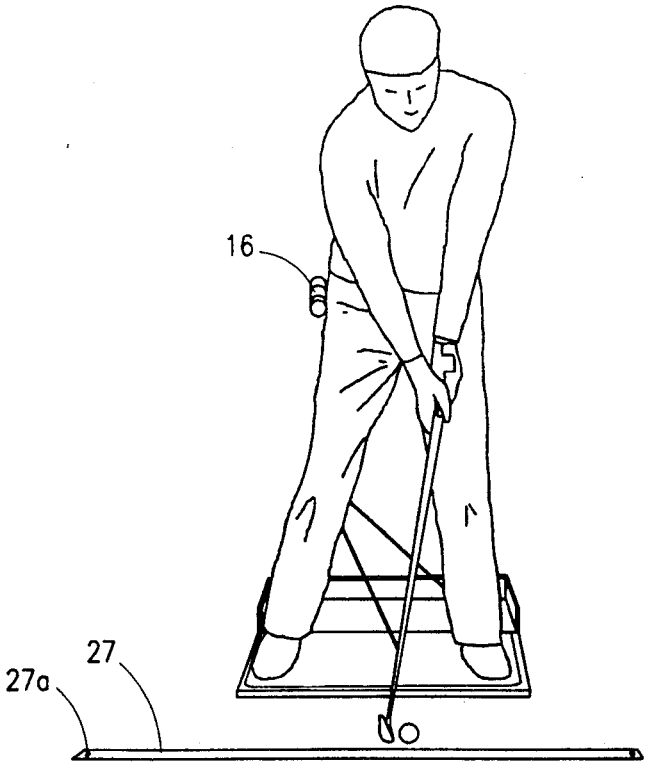

FIG. 6*b* is a vertical front isometric elevation view of a golfer utilizing the apparatus of the present invention, illustrating the golfer in the set up position for addressing the ball.

Figure 6C:
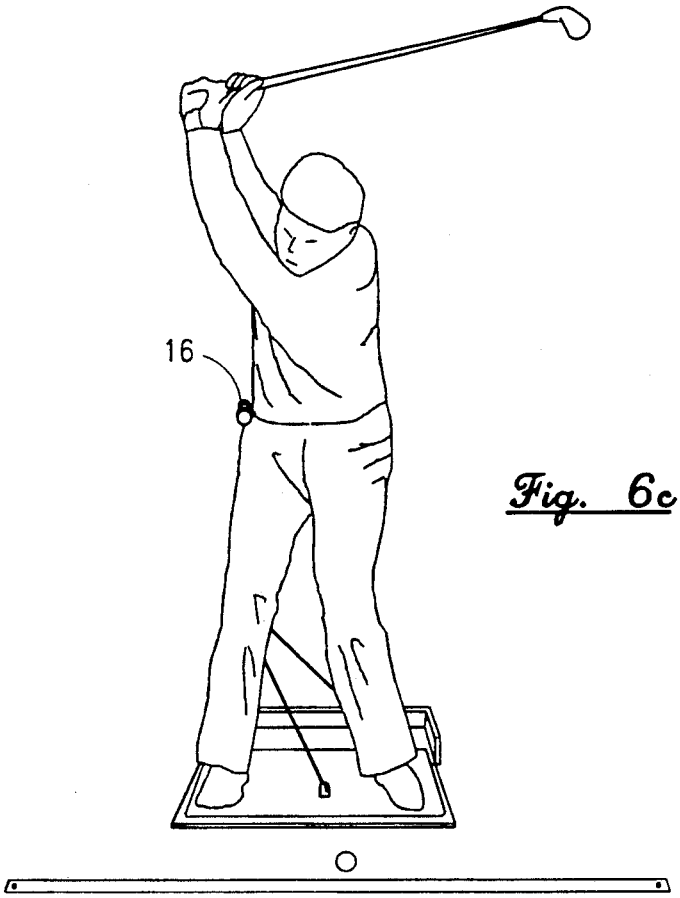

FIG. 6*c* is a vertical front elevation isometric view of a golfer utilizing the apparatus of the present invention, illustrating the communication imparted by the hip limitation barrier during the back-swing.

Figure 6D:
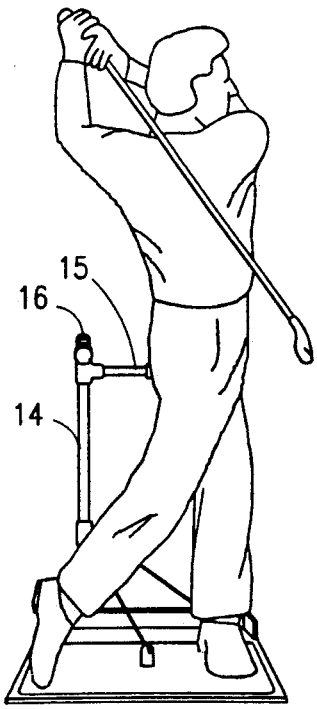

FIG. 6*d* is a vertical front elevation isometric view of a golfer utilizing the apparatus of the present invention, illustrating the communication imparted by the back and hip limitation barrier during the follow-through of the swing.

Figure 7:
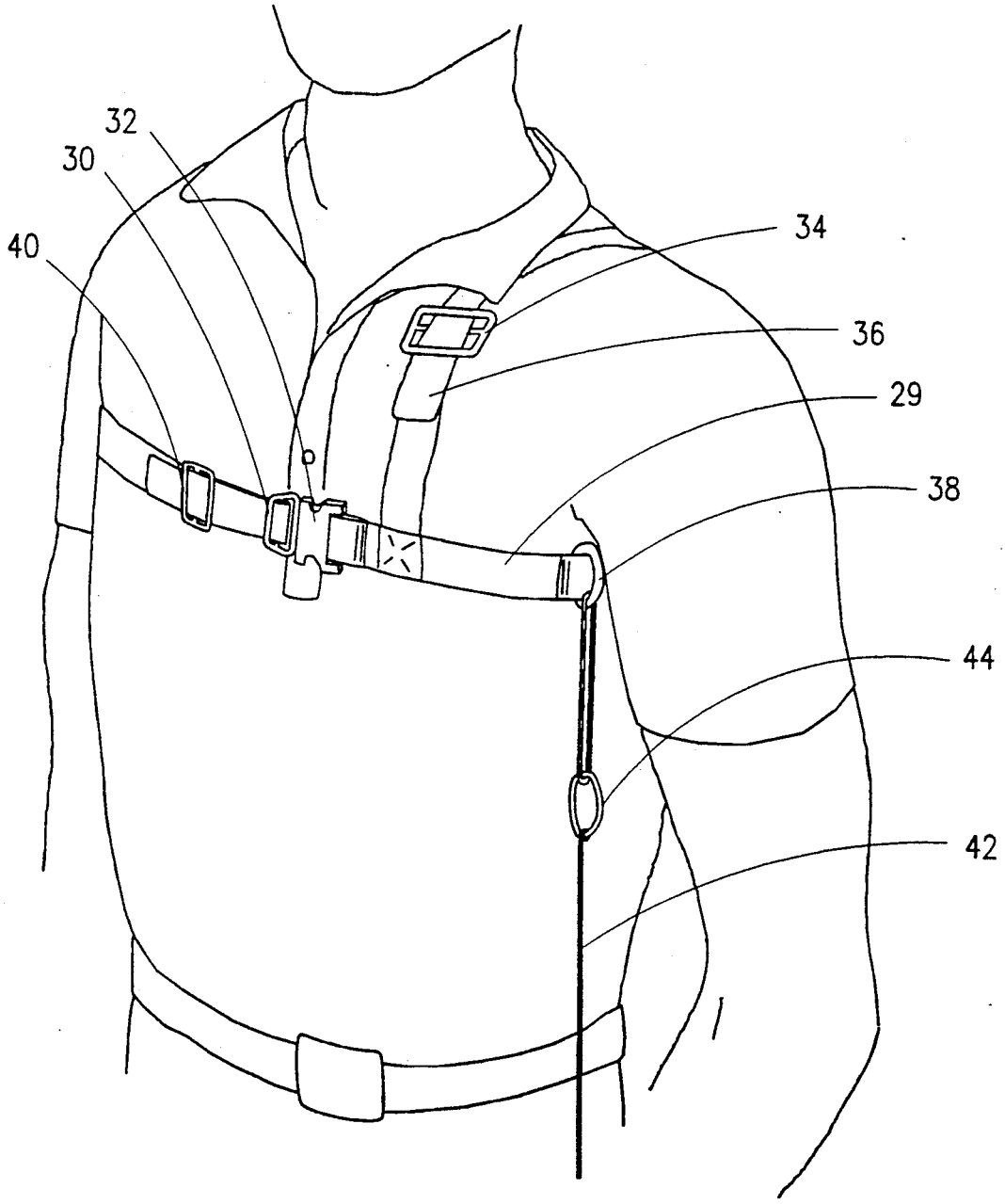

FIG. 7 is a partial isometric view of a golfer fitted with a chest harness, the second portion of the present invention.

Figure 8:
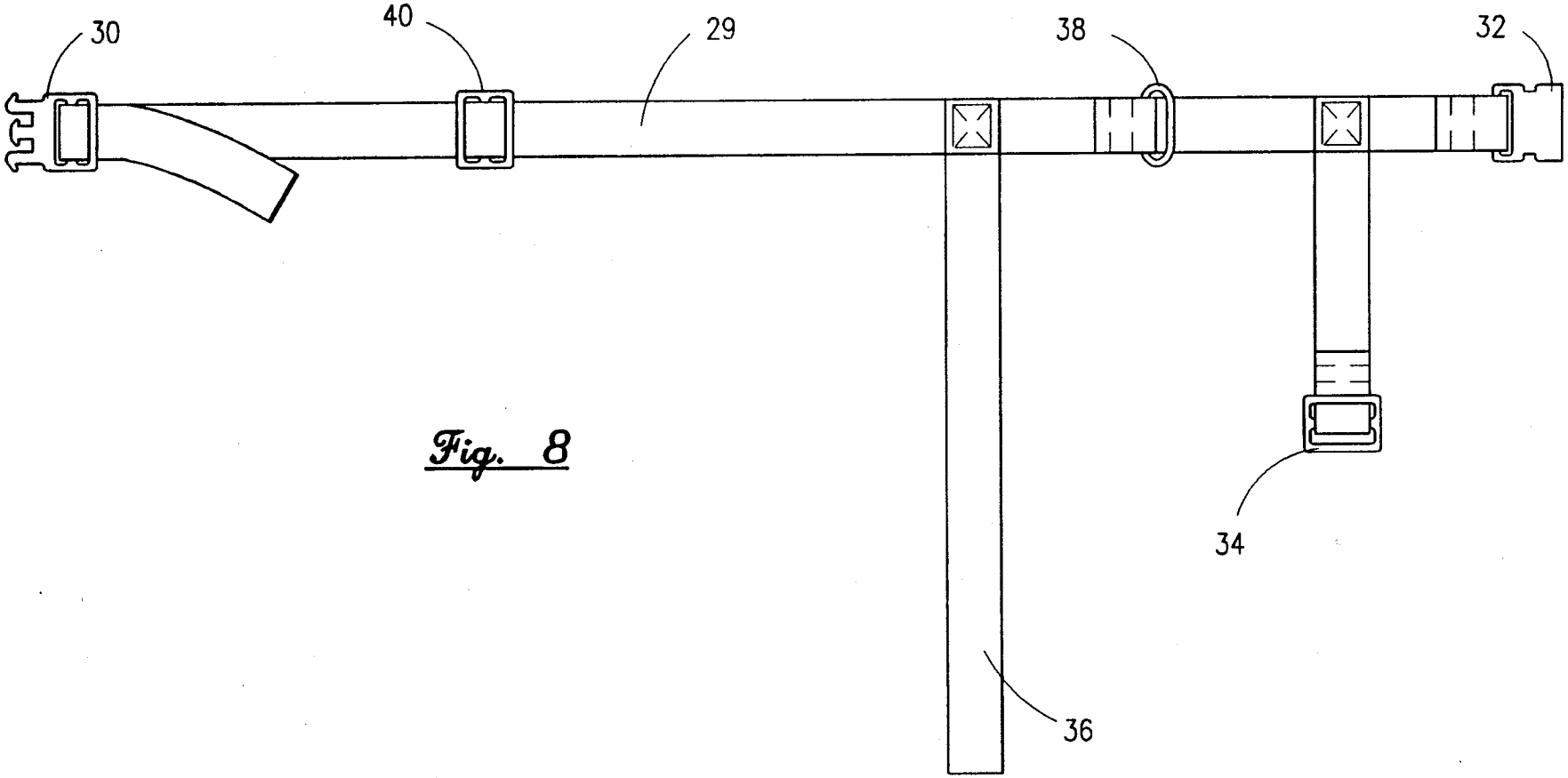

FIG. 8 is a plan view of the chest harness.

Figure 9:
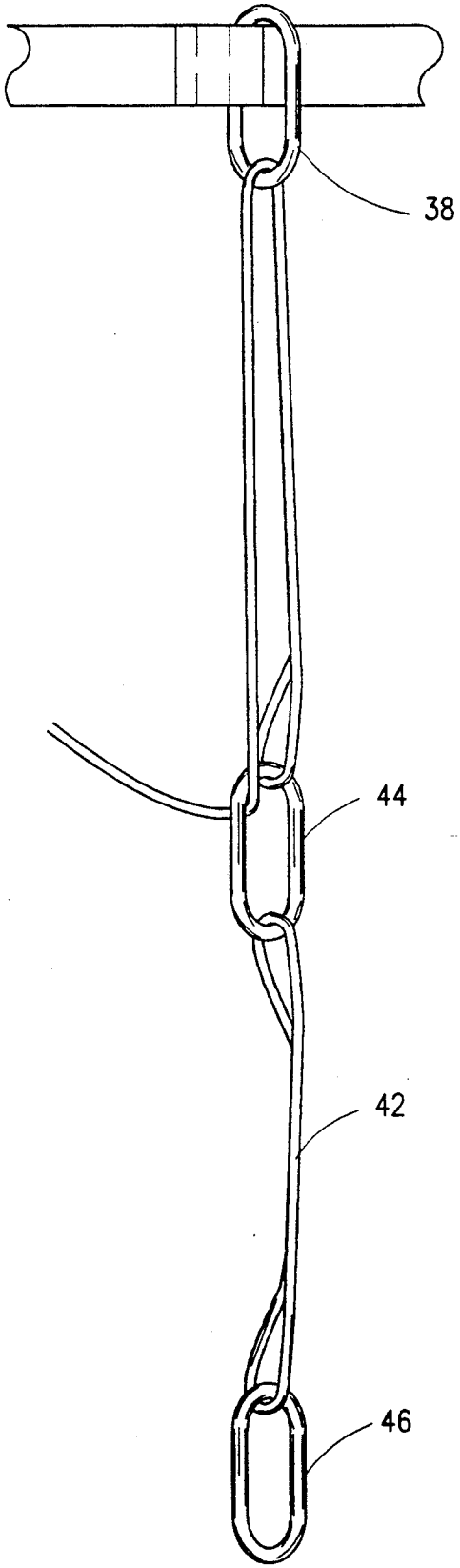

FIG. 9 is a partial isometric view of the chest harness with the cord or lanyard attached thereto.

Figure 10:
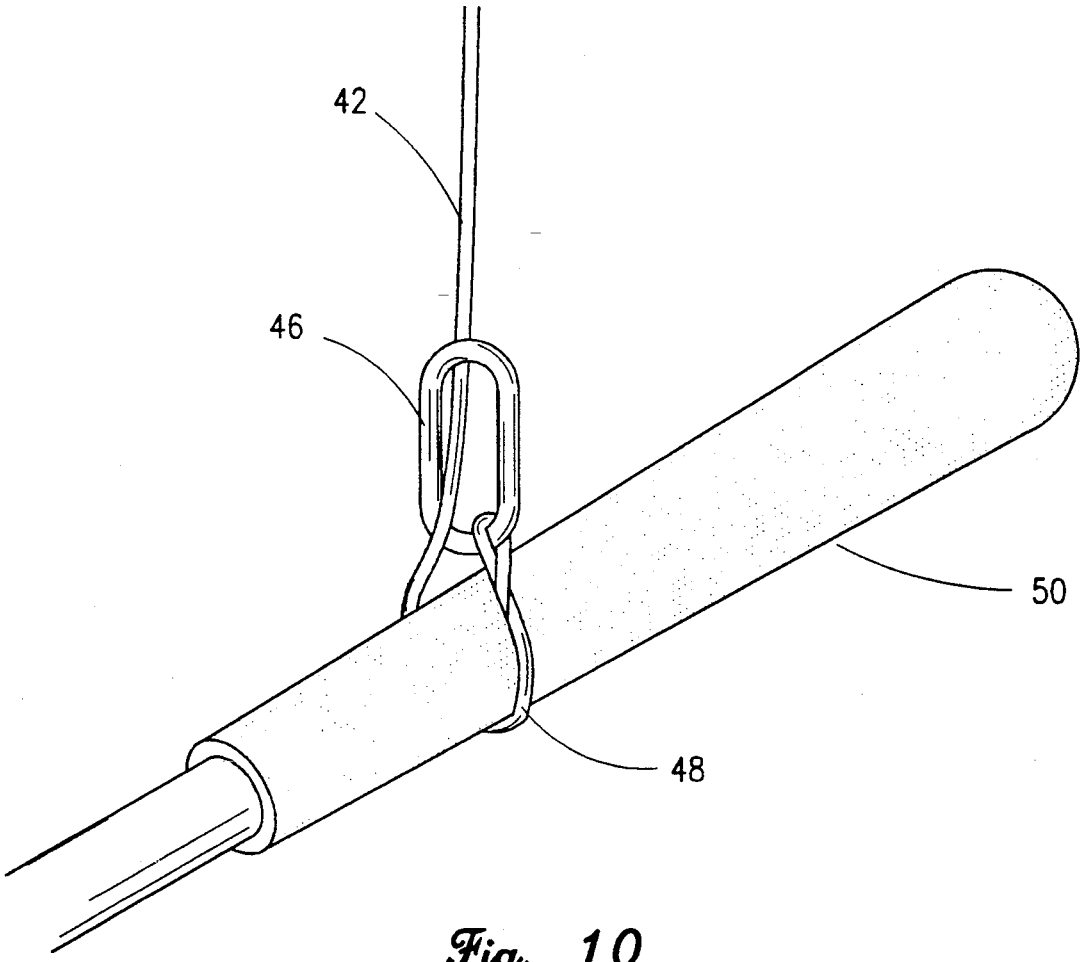

FIG. 10 is a partial isometric view of a golf club grip with the looped end of the chest harness cord or lanyard secured thereto.

Figure 11:
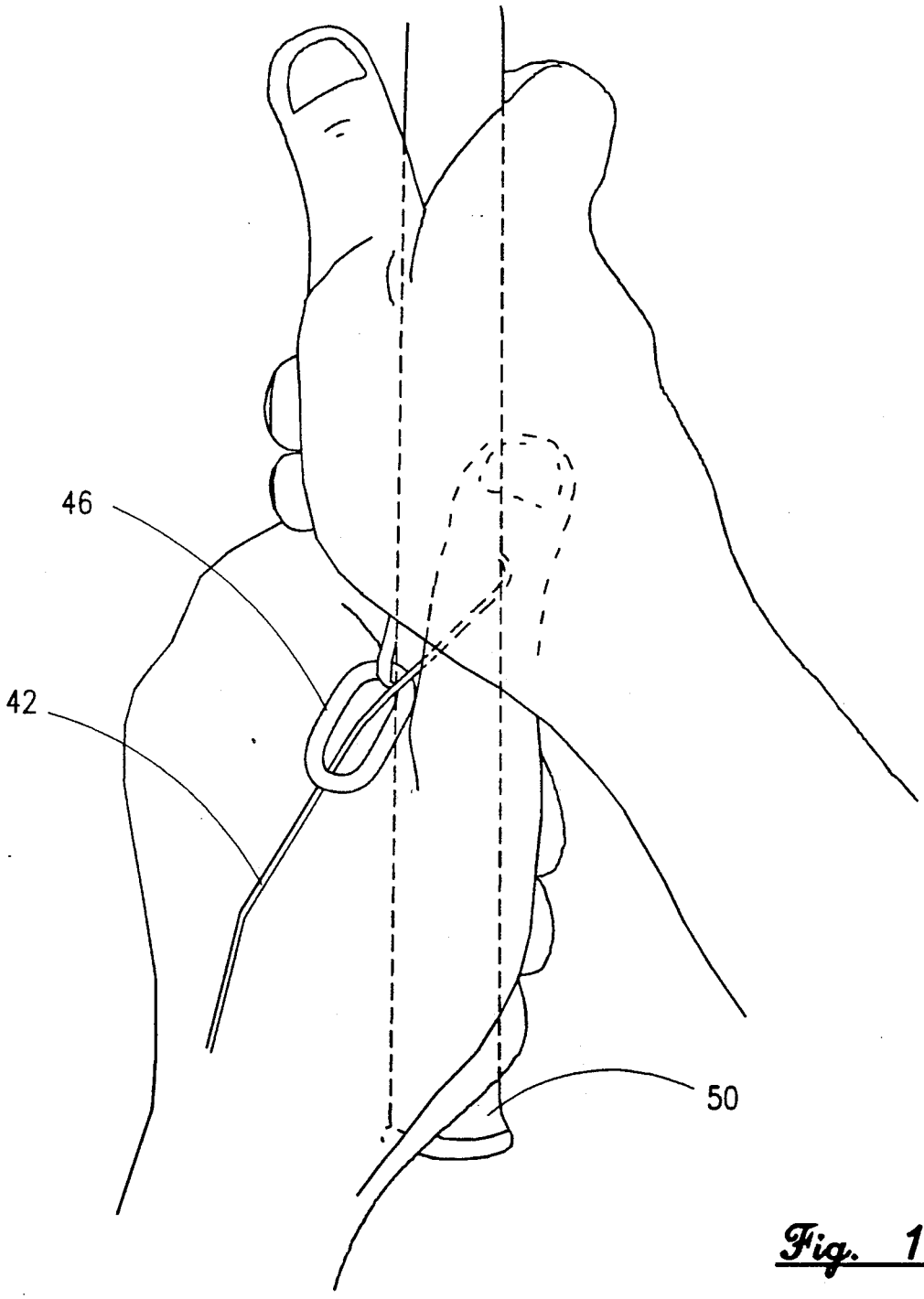

FIG. 11 is a partial isometric view of a golfers hands in the proper grip position while holding a golf club and the location of the chest harness cord or lanyard looped around the club grip relative to such hand position.

Figure 12A:
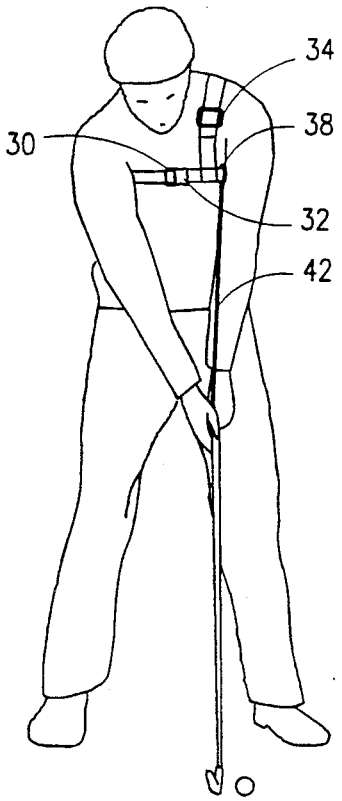
Figure 12B:
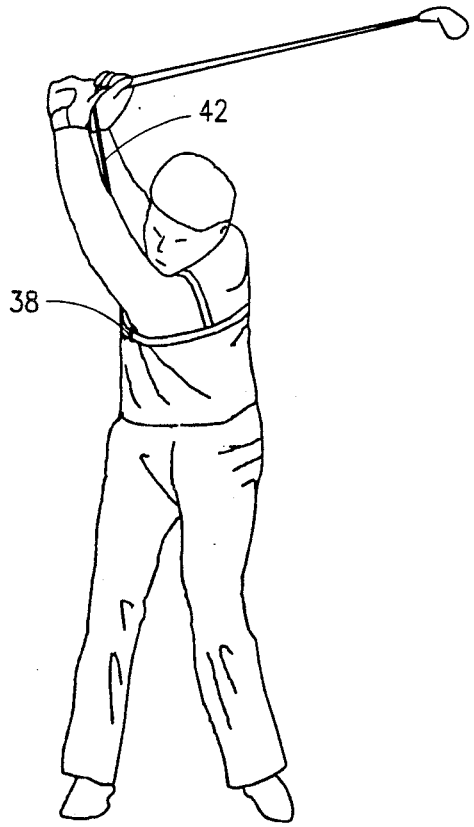

FIG. 12*a* is a vertical elevation frontal view of a golfer utilizing the chest harness portion of the present invention.

FIG. 2*b* is a vertical elevation frontal view of a golfer utilizing the chest harness portion of the invention and its commutative relationship to the golfer during the swing.

DESCRIPTION OF THE PREFERRED EMBODIMENTS

Figure 1A:
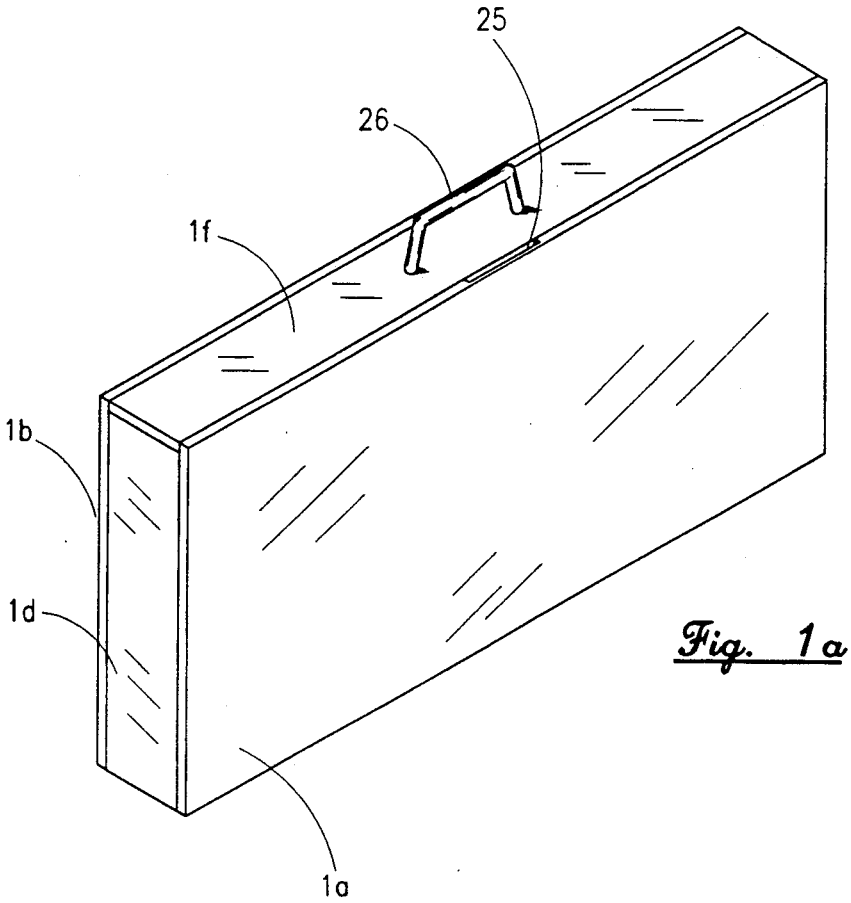
Figure 1B:
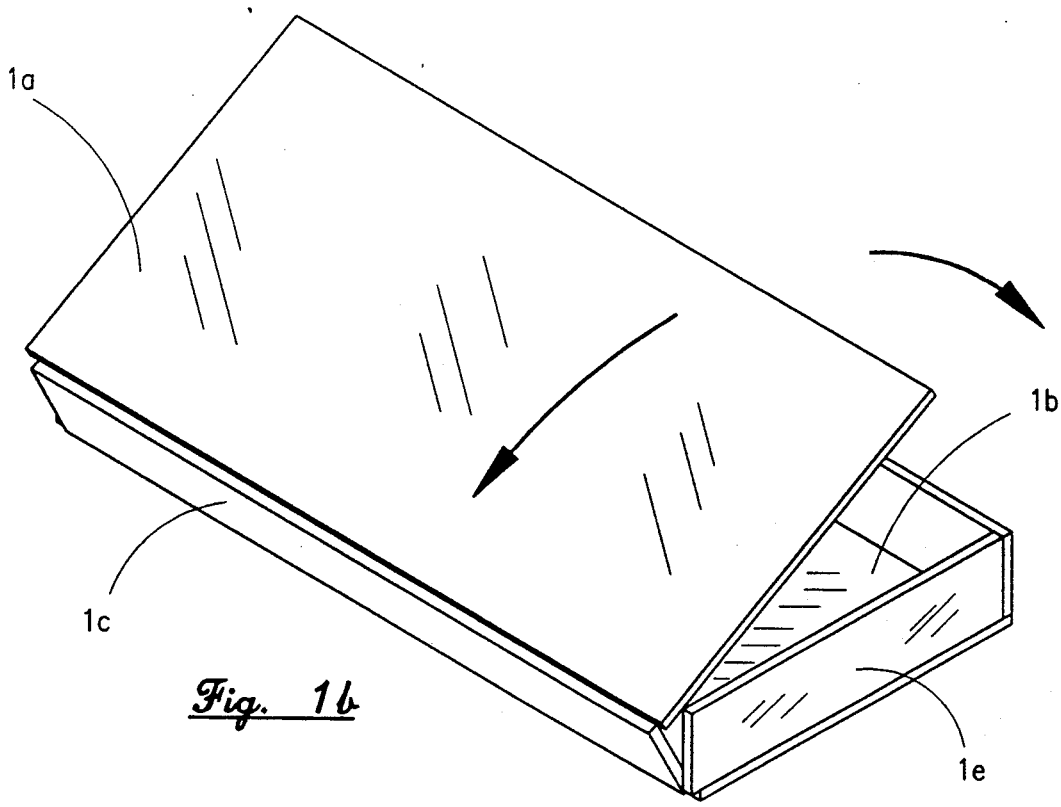
Figure 2:
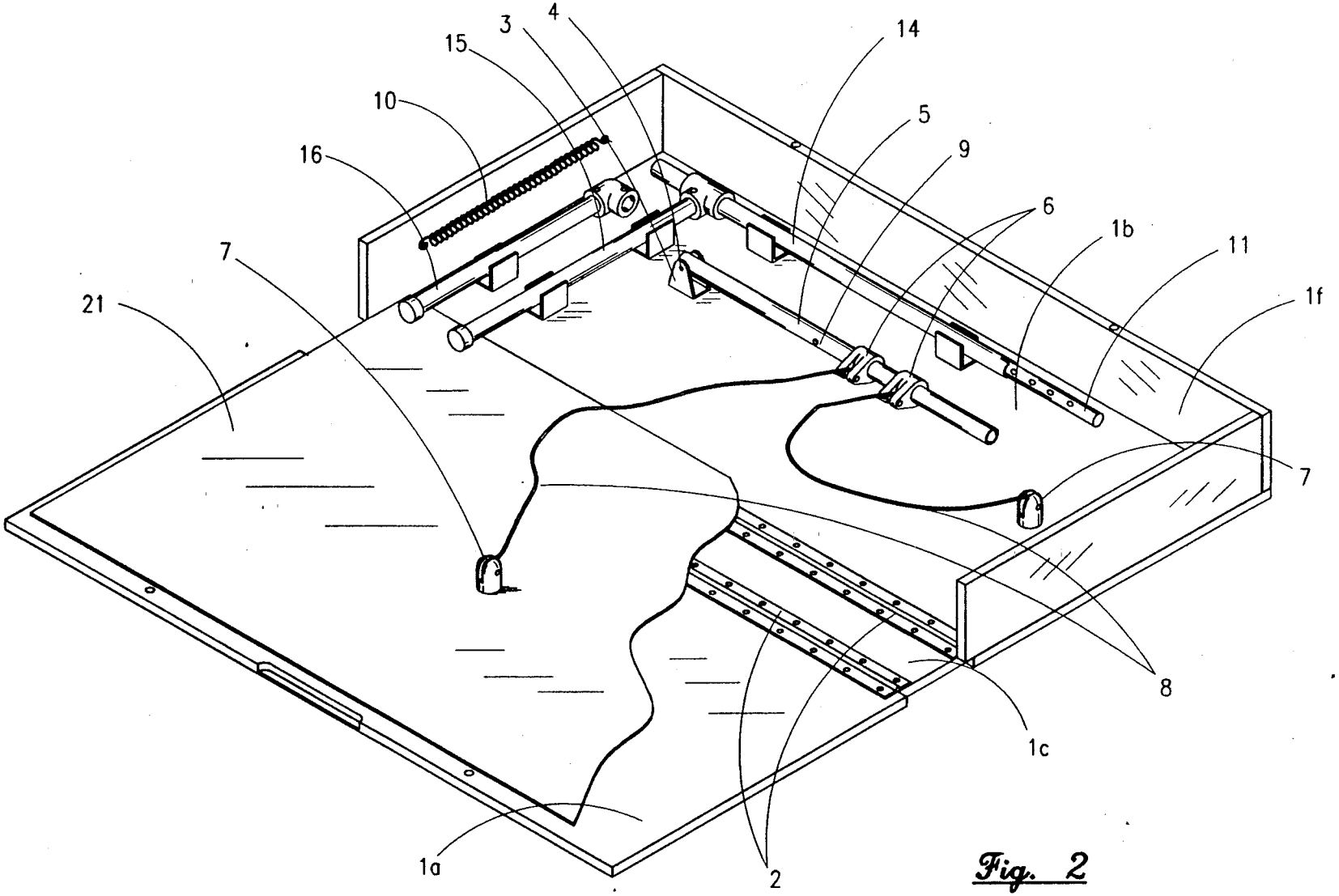
FIG. 2 is an isometric view of the interior of the transport box portion of the present invention with the first training aid folded in its transport mode.
Figure 3:
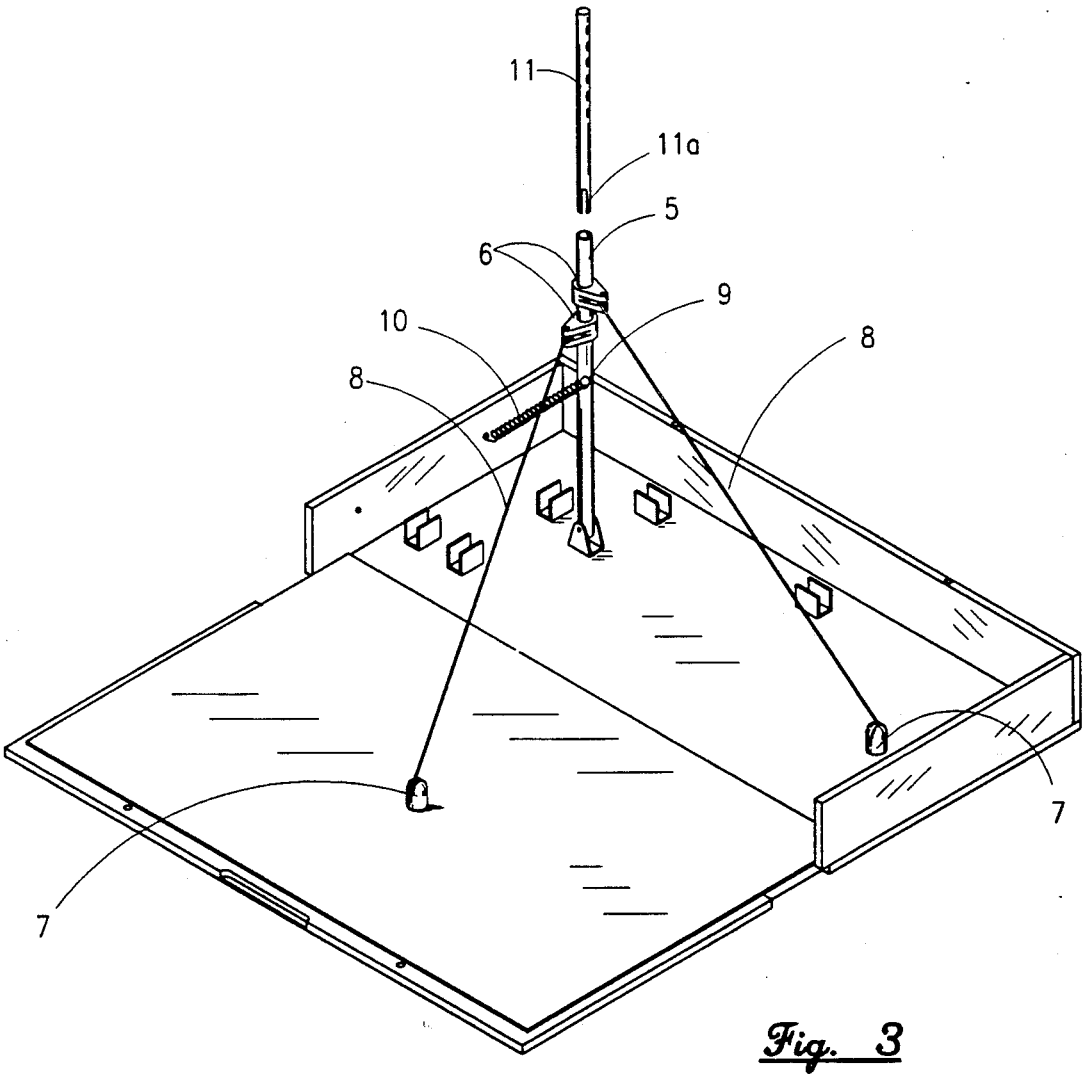
FIG. 3 is an isometric view of the present invention in which the guyed pole is shown erected.

Referring to FIGS. 1 through 5, it can be seen that this part of the invention, which may be referred to as a golf training aid center, which comprises a box into which the other parts of the center are fitted and transported. The box 1 comprises: three pieces forming the two sides 1*a*,1*b* heel 1*c*, held together and articulated by piano hinges 2; two side vertical rails 1*d*,1*e*; a top vertical rail 1*f*; and a carrying handle (26) located on the exterior of the top vertical rail 1*f*. FIG. 2 shows the interior of the box 1 open with the sides 1*a*,1*b*and heel 1*c* laying flat forming a platform upon which the golfer stands when addressing the ball and the connections for mounting the lower portion of the vertical pole 5 supported by guys 8. The lower pole portion 5, a hollow tube is pivotal about a pin 4 in the pivot bracket 3. Tube clamps 6 on the pole 5 serve as connections for one end of the guys 8, whereas, the opposite end of the guys 8 are connected to guy anchors 7 attached to the interior sides 1*a*, 1*b* of the box 1 serving to stabilize the pivotal portion of the pole 5 when in the erect position. A chamfer 25 located mid way along the leading edge of top vertical rails 1*f* provides an easy to access to open and lift the side 1*a*. A tension spring 10 attached at one end to one of the vertical side rails 1*d* of the box 1 is secured to the lower pole portion 5 when erected, by hooking onto a cross pin 9 located approximately two thirds or the way up the lower pole 5. The cross pin 9 is also used as a support and locating pin for the adjustment bar 11. FIG. 3 shows the pivotal portion of the lower pole 5 erected, the guys 8 taut and the spring 10 attached to cross pin 9. The adjustment tube 11 is telescopically fitted into the lower pivotal portion of pole 5 in a manner so that the locating slot 11*a* at the bottom of the adjustment bar 11 straddles and is supported by cross pin 9 thereby preventing the adjustment bar 11 from rotating. The lower portion of pole 5, is also prevented from rotating by the pivot bracket pin 4 in pivot bracket 3. It will be clear from examination of FIGS. 2 and 3 that the guys 8 could just as easily be cords, chains or rods. The preferred embodiment, however, uses chains for greater tensile strength, flexibility and neatness of packing. It is recognized that golf is an outdoor sport and it is not unreasonable to expect golfers to take the device outside. Therefore, it is preferred that materials which are resistant to the elements be used when ever possible. Turning now to FIG. 4*b* which shows the assembly of the hip bar 16 and the buttocks bar 15 to the upper part of the upper pole portion 14, the upper portion of the pole 14 and lower portion of the pole 5, being separated to allow the intermediate adjusting bar 11 to perform its task. By using a connecting pin 12 and securing clip 13, secured through any of the holes provided for the adjustment of the height of the buttock bar 15 and the hip bar 16 in the adjusting bar 11, a support can be provided at different heights for the upper pole portion 14, which also has a slotted cut-out at its lower end to prevent rotation, when telescoped over the adjustment bar 11. A second pin 12 and securing clip 13 is used to prevent rotation of the elbow joint (90 degree) bar clamp 18 located at the top of the upper pole portion 14. The hip bar 16 is secured in the elbow joint 18 by a set screw 20. The hip bar 16 is positioned at a right angle to the vertical pole and points towards the open box side 1*a* and parallel to the vertical side rails 1*d*,1*e* of the box 1. The buttocks bar 15 is attached to the upper pole portion 14 by a T-joint 17 and is secured in the T-joint by set screws 20. The T-joint is likewise attached securely to the upper pole portion 14 by set screws 20. The buttocks bar 15 also makes a right angle with the upper pole 14 and is positioned at a right angle with the hip bar 16 in the horizontal plane. The buttocks bar 15 points in a direction which is parallel to the long vertical rail 1*f*. The ends of the hip and buttocks bars 15,16 are covered by protective tube caps 19. FIG. 5 shows the completely assembled golf training center, with the addition of lightweight ribbed carpeting 21 or artificial turf, Secured to the interior of the box 1. The carpet is not secured directly over hinges so as not to interfere with the box's hinges 2 action. The box 1 is preferably secured, when closed, by snaps as shown in FIG. 5, the male portion 23 located on the long vertical rail 1*f* and female portion 24 located on the open side 1*a*. In FIG. 6*a* it can be seen that the golfer's buttocks should be slightly in contact with the buttocks bar 15 and his hip slightly in contact with the hip bar 16, though the former may be seen to a greater advantage in FIG. 6*b*. The hip bar 16 should be preferably adjusted to a height which is half the barefoot height of the golfer, at which height the hip bar 16 is generally level with the golfer's hip socket at set-up (the normal position when addressing the ball). To dismantle the aforementioned practice aid simple reverse the procedure. It should also be noted that spring clips 22 are fitted in the box at strategic positions to secure the pole assembly and other aids.

Turning now to FIG. 7 we see the second of the present invention's training aids, the swing harness 29. The swing harness of the present invention is fabricated from a light weight woven polypropylene. The harness is easily installed and removed via a push fit clip or fastener 30,32, as depicted in FIG. 8. The sliding shoulder clasp 34, and the chest strap adjustment 40 provides easy adjustment for comfort. The swing harness 29, is double sewn for stability and strength. The swing harness is further fitted with a "D" ring 38, which is securely sewn into the webbing of the harness 29 at a location immediately below the golfers armpit. FIG. 9 depicts the use of a cord or lanyard 42, and how it attaches to an intermediate ring 44. A fixed length of cord 42 is permanently secured between the two small rings 44,46. Another length of cord is secured to one of the small rings 44,46 and passed through the "D" ring 38 secured to the chest harness 29 and back to the small ring 44 where the golfer may tie the loose end after adjusting its length so the distance between the small ring 44 and the "D" ring 38 to suit the maximum reach of his arms.

It is preferred that the cords be continuous multifilament nylon with a light twist and a diameter of about one sixteenth of an inch. Nylon is preferred because of its high strength, high resistance to abrasion, is soft, flexible and unobtrusive. At the cords opposite end yet another small ring 46 is provided. The purpose of this small ring 46 is amply illustrated in FIG. 10. The cord 42 is pulled through the ring 46 to form a loop 48 which may be passed with no difficulty over the golf club grip 50. The position of the loop 48 about the club grip 50 can be seen in FIG. 11. The loop is located comfortably between the hands which are in a normal grip position, and the cord 42 passes through the crook between the left thumb and the left palm. Since the cord 42 may abrade the webbing of the hand in this location during extended periods of practice, the golfer is advised to wear a glove on the hand as he would normally during play in any case.

The third part of the present invention involves the use of a means for marking the sight line of the club head during the back swing and the follow-through. The preferred embodiment of a marking means for this purpose comprises a length of bright yellow ribbon 27 shown in FIGS. 6*a–c*, having metal eyelets 27*a* at each end for securing to the ground by ground anchors, nails, golf tees or other such devices. The ribbon should be placed in a taut straight line as shown in FIGS. 6*a–c*. pointing towards the target, slightly beyond the placement of the ball with approximately half the ribbon's length ahead of the ball. The ribbon should be constructed of a tightly woven fiber type which resists moisture, mildew and ultra violet degradation. The preferred fiber would be polypropylene containing a hindered amine light stabilizer. Similarly, the eyelets should be of a material such as brass which does not rust, rot or degrade.

Embodiments of the three parts of the invention have been described. It is recognized that those skilled in the art may find other ways of achieving the requirements presented. Therefore, it should also be understood that the illustrations presented herein serve only to illustrate the preferred embodiment of the invention and should not to be construed as presenting limitations to the invention.

What is claimed is:

1. A golf swing training aid kit comprising:

a) A carrying case;

b) a pole, attached to the interior of said carrying case;

c) a chest harness means; and d) a sight guide line marking means.

2. A golf swing training aid kit as in claim 1 wherein a portion of said carrying case folds out into a flat platform upon which a golfer stands during practice.

3. A golf swing training aid kit as in claim 2 wherein said flat platform of said carrying case is covered with artificial turf.

4. A golf swing training aid kit as in claim 3 wherein said pole comprises: a lower pivotal portion, attached to said carrying case; an upper portion; an intermediate portion, telescopically fitted into said upper and lower portions, to allow for height adjustment; and hip and buttocks bars, attached at right angles to said upper portion.

5. A golf swing training aid kit as in claim 4 wherein said pole is secured in a vertical position by at least two guys attached to the interior of said carrying case.

6. A golf swing training aid kit as in claim 5 wherein said pole is further secured and said guys held taut by a biasing means attached to said pole and interior of said carrying case.

7. A golf swing training aid kit as in claim 6 wherein said buttocks bar is rotatable and adjustable laterally along said pole's upper portion.

8. A golf swing training aid kit as in claim 7 wherein said chest harness means comprises: an adjustable chest strap, having a push snap fastener; an adjustable shoulder strap, sewn to said chest strap; a steel "D" ring, attached to said chest strap; and a cord or lanyard, having a steel ring at one end, for looping around a golf club, and attached at its opposite end to said chest strap's "D" ring.

9. A golf swing training aid kit as in claim 8 wherein said sight guide line marking means is a ribbon, having eyelets for inserting ground anchors or the like.

10. A golf swing training aid kit comprising:

a) A rigid carrying case;

b) a tubular pole assembly, pivotally attached to the interior of said carrying case;

c) a chest harness means, to be worn by a practicing golfer;

d) a cord means, for securing to a golf club, attached to said harness means; and d) a sight guide line marking means, for aligning the golfers club during the swing.

11. A golf swing training aid kit as in claim 10 wherein said carrying case opens out in a manner so a portion of the cases's interior provides a flat platform upon which a golfer stands during practice.

12. A golf swing training aid kit as in claim 11 wherein said carrying case's flat portion is fitted with artificial turf.

13. A golf swing training aid kit as in claim 12 wherein said tubular pole assembly comprises: a lower portion, which is pivotally attached to said carrying case; an upper tubular portion; an intermediate bar, telescopically fitted into said upper and lower portion, to allow for height adjustment; and hip and buttocks bars, attached at right angles to said upper portion.

14. A golf swing training aid kit as in claim 13 wherein said tubular pole is secured in a vertical position by at least two guys attached to the interior of said carrying case and connected to tube clamps on said tubular pole.

15. A golf swing training aid kit as in claim 14 wherein said tubular pole is further secured and said guys held taut by a biasing means attached to said tubular pole and interior of said carrying case.

16. A golf swing training aid kit as in claim 15 wherein said buttocks bar attachment is rotatable and adjustable laterally along said upper tubular pole portion.

17. A golf swing training aid kit as in claim 16 wherein said harness means comprises: an adjustable chest strap, having a push snap fastener; an adjustable shoulder strap sewn to said chest strap; a steel ring, attached to said chest strap; and a cord or lanyard secured to said steel ring, itself having a steel ring, for looping around a golf club.

18. A golf swing training aid kit as in claim 17 wherein said sight guide is a ribbon, having eyelets for inserting ground anchors or the like.

19. A method of training a golfer in proper swing techniques comprising:

a) Passively encouraging the golfer to reduce or eliminate the swaying of the golfer's hip away from the intended target, by the use of a barrier;

b) passively discouraging the movement of the golfer's buttocks, and thus controlling the amount of bending of the knees or waist, by the use of a barrier;

c) establishing the location of the golfer's center of gravity in the set-up position, by providing extension limitations for the positions of the golfer's feet with respect to said hip and buttock barriers, thus the golfer's weight is of necessity shifted towards his leading foot and away from the foot adjacent said passive hip barrier;

d) maintaining extension of the golfer's leading arm throughout the back and downswing, by passively limiting the arc radii;

e) allowing the golfer to experiment with the timing and extent of the cocking of the wrists, by pivoting the golf club about the fulcrum provided by arc radii limiting means; and f) utilization of the golfer's peripheral vision to insure the proper level and direction of the swing, by the use of a guide path marking means.

* * * * *